US012503816B2

(12) United States Patent
Transier

(10) Patent No.: US 12,503,816 B2
(45) Date of Patent: Dec. 23, 2025

(54) SCREEN SUPPORT ROD FOR SCREEN DRAWING INTO A PAPER MACHINE

(71) Applicant: Voith Patent GmbH, Heidenheim (DE)

(72) Inventor: Gordon Transier, Neufahrn (DE)

(73) Assignee: Voith Patent GmbH, Heidenheim (DE)

( * ) Notice: Subject to any disclaimer, the term of this patent is extended or adjusted under 35 U.S.C. 154(b) by 314 days.

(21) Appl. No.: 18/222,463

(22) Filed: Jul. 16, 2023

(65) Prior Publication Data

US 2024/0018720 A1 Jan. 18, 2024

(30) Foreign Application Priority Data

Jul. 18, 2022 (DE) ..... 102022117869.2

(51) Int. Cl.
*D21F 7/00* (2006.01)

(52) U.S. Cl.
CPC ..... *D21F 7/001* (2013.01); *D21F 7/005* (2013.01)

(58) Field of Classification Search
CPC ..... D21F 7/001; D21F 7/005; D21F 7/00
See application file for complete search history.

(56) References Cited

FOREIGN PATENT DOCUMENTS

| | | | |
|---|---|---|---|
| CN | 101506434 | | 8/2009 |
| CN | 105452562 | | 3/2016 |
| CN | 113699821 | | 11/2021 |
| DE | 1945230 | A | 4/1970 |
| DE | 3836164 | A1 | 4/1990 |
| DE | 102006000324 | A1 | 1/2007 |
| DE | 102006022028 | A1 | 11/2007 |
| GB | 503118 | A | 3/1939 |
| GB | 806227 | | 12/1958 |
| GB | 958055 | | 5/1964 |
| WO | WO2007144461 | A1 | 12/2007 |

*Primary Examiner* — Dennis R Cordray
*Assistant Examiner* — Matthew M Eslami
(74) *Attorney, Agent, or Firm* — Von Rohrscheidt Patents

(57) ABSTRACT

A screen support rod for screen drawing into a paper machine, the screen support rod including a support tube made from carbon fiber composite material; a telescoping rod; and a bearing that supports the telescoping rod axially movable in an interior of the support tube, wherein the support tube includes a shrink tube that forms a surface that supports the screen during the screen drawing.

15 Claims, 3 Drawing Sheets

SCREEN SUPPORT ROD FOR SCREEN DRAWING INTO A PAPER MACHINE

RELATED APPLICATIONS

This application claims priority from and incorporates by reference German Patent Application DE 10 2022 117 869.2 filed on Jul. 18, 2022.

FIELD OF THE INVENTION

The invention relates to a screen support rod for screen drawing into a paper machine. The invention further relates to a support tube for the screen support rod.

BACKGROUND OF THE INVENTION

Screen support rods for pulling continuous screens into a paper machine are known in the art. The screens also include felts and other webbing used in a paper machine. Paper machines are all machines for producing paper or paper like fiber webs, like, for example, cardboard, tissue or pulp.

The continuous screen is initially placed without tension into a required shape of the screen inlet by plural screen support rods laterally adjacent to the respective section of the paper machine wherein respective sides of the screen support rods are supported at a frame of the paper machine. Thus, a respective telescoping rod is pulled out of the support tube so that the telescoping rod can be attached or supported at the frame of the paper machine. The other side of the screen support rods is supported in a frame or at the building or supported by a building crane. Subsequently the support tubes of the screen support rods are moved towards the paper machine, wherein the telescoping rods slide back into the support tubes until the support tubes with the screen are arranged laterally adjacent to rollers that are configured to carry the screen in the paper machine. Thereafter, the screen is pulled laterally over the screen support rods or over its support tubes onto the rollers until the screen has arrived at a desired position in the paper machine. Thus, the screen slides over the surface of the screen support rods or its support tubes.

The support of the telescoping rod in the support tube is configured so that it facilitates relative linear movement and provides a sufficiently stable connection between telescoping rod and support tube for supporting the screen even in an extended position.

Screen support rods for pulling continuous screens into a paper machine are described in GB 503118 A. Some screen support rods are already used for supporting continuous screens as described therein.

DE 1945230 A discloses that a sensitive surface of the screens can be damaged when pulled over the screen support rods during drawing. In order to prevent this, it is proposed that the entire frame that supports the screen support rods is configured so that it can be moved into the paper machine and remain therein. Thus, no screens are laterally pulled over the screen support rods. However, this solution is rather complex and not possible in every paper machine due to space constraints.

BRIEF SUMMARY OF THE INVENTION

Thus, it is an object to the invention to provide a more flexible and economical option for pulling screens into the paper machine while assuring that the surface of the screens is not damaged.

The object is achieved by a screen support rod for screen drawing into a paper machine, the screen support rod including a support tube made from carbon fiber composite material; a telescoping rod; and a bearing that supports the telescoping rod axially movable in an interior of the support tube, wherein the support tube includes a shrink tube that forms a surface that supports the screen during the screen drawing. Additional advantageous embodiments of the invention can be derived from the dependent claims.

The advantageous embodiment is characterized in that at least one shrink tube is applied to the support tube so that the shrink tube forms a surface where the respective screen is supported when used for screen drawing. The shrink tube renders the surface of the support tube smooth enough so that the screen is not damaged when pulled over the shrink tube. Furthermore, a shrink tube is inexpensive and can be applied in a simple manner. The surface of the CFC support tube without the cover is too rough and would damage the screen when the screen is pulled over the surface. On the other hand side, carbon fiber composite material is a preferred material for the support tube since it makes the screen support rod lighter and thus simplifies handling and transporting the screen support rod.

Thus, the invention provides a light screen support rod that is easy to handle and economical. The screen support rod is still light weight for wide screens and can be produced in a flexible manner for a different screen widths. And most important, there is no risk of damaging the sensitive surface of the screens during screen drawing.

As another advantage the shrink tube can be replaced easily after it has been damaged thus, the screen support rod can be repaired easily. It is also possible to only remove a portion of the shrink tube and replace the portion by a new shrink tube portion. Since the shrink tube is mounted in a simple manner by heating, repairs can be made without much complexity on site.

A shrink tube is a thermoplastic synthetic material tube that radially contracts under heat impact, for example, from a hot air blower. Thus, the shrink tube can be applied to the support tube in a simple manner. Shrink tubes are produced by radially expanding extruded tubes when hot and cooling the tube in expanded condition. Thus, the expansion initially remains fixed in the shrink tube. The shrink tube contracts when heated again. Particularly advantageously a hard PVC shrink tube is used according to the invention in order to form an abrasion resistant surface. Since the shrink tube is applied to a constant diameter tube, a small shrink ratio is sufficient. Advantageously the outer diameter of the support tube is between 80 mm and 250 mm. This depends from a width of the screen and a stiffness requirement of the support tube. The length of the support tube is at least equal to a width of the screen to be pulled. Typical lengths of the support tube are between 3 meters and 14 meters, advantageously between 8 meters and 13 meters.

The telescoping rod is typically configured as a tube and has a length between 2 meters and 5 meters, advantageously between 3 meters and 4 meters. Thus, the screen can be placed at a sufficient distance next to the paper machine before it is moved proximal to the rollers in the paper machine by a linear movement of the screen on the telescoping rod.

CFC stands for carbon fiber reinforced synthetic material. Particularly advantageously the support tube is made from CFC with continuous fibers. A durometric material, advantageously epoxy resin is used as the matrix material.

Advantageously the shrink tube is applied in plural shrink tube sections adjacent to each other. Thus, the shrink tube can be mounted in a simpler manner. This is advantageous in particular for very long support tubes. Furthermore, an individual section of the shrink tube can be removed more easily when the surface is damaged and replaced with a new section. This makes repairs quicker and more economical.

The support tube is provided in particular as a wound CFC tube. The support tube can be provided with a small wall thickness when produced by a winding method while still providing a high level of bending stiffness. This advantageously provides low weight.

In an advantageous embodiment, the telescoping rod is a metal tube, in particular made from aluminum or an aluminum alloy. This achieves a good balance between stiffness and weight even for a small diameter.

Alternatively, the telescoping rod can be provided as a CFC tube, in particular a wound CFC tube. This is particularly advantageous when a slightly larger diameter combined with low weight is required.

Furthermore, the telescoping rod is supported in at least one sliding bushing made from a synthetic material, in particular made from POM and advantageously in two sliding bushings made from the synthetic material, in particular from POM. POM is short for polyoxymethylene, also designated as polyacetal. This is a thermoplastic synthetic material with high stiffness and good shape keeping and low friction coefficient. Thus, POM is particularly suitable for bushings that support the telescoping rod in the support tube. Compared to known roller bearings this bushing support requires less installation space and is also lighter. The sliding bushings are easily producible by injection molding.

In particular the sliding bushing or the two sliding bushings are attached at the telescoping rod by a press fit. This can be implemented easily when the telescoping rod is made from metal and the sliding bushing is made from POM.

In another advantageous embodiment, the support tube is provided with a metal head piece at both ends, wherein the head pieces are advantageously attached at the support tube by a press fit. Thus, edges of the CFC support tube are protected against being damaged. The head pieces facilitate mounting the support tube in a receiver in a machine frame, at the building or at a building crane.

Additionally, one of the head pieces can be configured so that it supports and/or guides the telescoping rod when displaced in the support tube.

Furthermore, the invention relates to a support tube for a screen support rod. The object is achieved by a support tube Thus, the support tube is provided for an application in a screen support rod, in particular for a screen support rod configured according to one of the preceding claims. Additional advantageous embodiments of the support tube according to the invention as specified in the dependent claims. The embodiment according to the invention is characterized in that at least one shrink tube is applied to the support tube so that the shrink tube forms the surface that supports the screen during wire drawing.

As described supra, the shrink tube is applied in plural shrink tube sections adjacent to each other. Advantageously the support tube is configured as a wound CFC tube. Advantageously the support tube is provided with a metal head piece at each end wherein the respective head pieces are attached in the support tube by a press fit.

BRIEF DESCRIPTION OF THE DRAWINGS

The invention is subsequently described based on advantageous embodiments with reference to drawing figures. Like components are designated with identical reference numerals in the drawing figures, wherein.

DETAILED DESCRIPTION OF THE INVENTION

Figure 1:
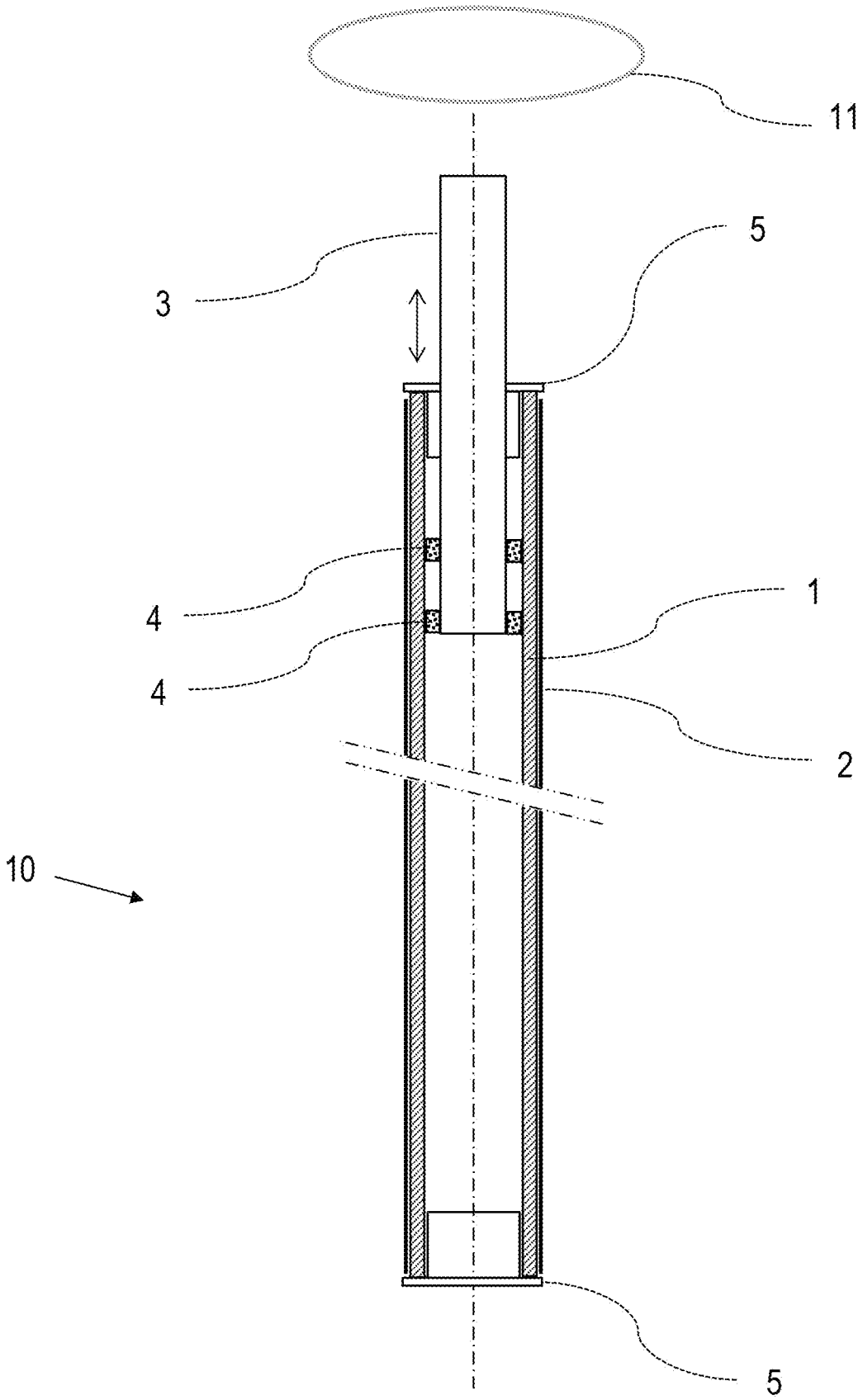
FIG. 1 illustrates a schematic view of a screen rod support including a support tube according to the invention.

FIG. 1 shows the screen support rod 10 according to the invention including the support tube 1 according to the invention provided with the shrink tube 2 on an outside. The shrink tube 2 is applied so that it forms the surface that is in contact with the screen during wire drawing. The screen support rod 10 is made from CFC and advantageously provided as a wound CFC tube. Thus, the support tube can be configured particularly light with good bending stiffness. Furthermore, a telescoping rod 3 is provided that is supported axially displaceable in a bearing in the support tube 1. The telescoping rod 3 is advantageously provided as a metal tube, in particular made from aluminum or aluminum alloy.

In order to draw a continuous screen 11 in a paper machine the screen 11 is initially arranged by plural screen support rods 10 adjacent to the paper machine as a screen loop. Thus, the telescoping rod 3 is extended and its free end is attached at a desired position at the frame of the paper machine. The opposite end of the support tube 1 is supported at the frame, at the building or by a building crane. When the continuous screen is arranged in the desired shape of the screen loop the support tube 1 with the screen is moved towards the paper machine so that the telescoping rod 3 is slid into the support tube 1. Thus, the screen is arranged laterally adjacent to the rollers of the paper machines that will support the screen. Subsequently the screen is pulled laterally onto the rollers in the paper machine. Thus, the screen slides over the surface of the screen support rod 10. Since this surface is formed by the smooth shrink tube 2, the sensitive screen is protected against being damaged.

The support tube 1 can be provided with metal head pieces 5 at respective ends of the support tube wherein the head pieces are advantageously attached in the support tube 1 by a press fit. The head pieces 5 protect and reinforce the edge of the support tube 1. Furthermore, the head pieces facilitate receiving the screen support rod 10 in a holder or at a building crane. Additionally, one of the head pieces 5 can be configured so that the telescoping rod 3 is guided and/or supported therein when the telescoping rod 3 is pushed out of the support tube 1.

Additionally, the illustrated embodiment includes two sliding bushings 4 which are advantageously made from POM and configured as rings. The sliding bushings 4 function as supports for the telescoping rod 3 in the support tube 1 and facilitate an axial displacement of the telescoping rod 3. POM is a suitable material since it has a high level of stiffness and dimensional stability combined with a low friction coefficient. The sliding bushings 4 are advantageously pressed into the telescoping rod 3.

The shrink tube 2 is advantageously made from hard PVC which forms a smooth and abrasion resistant surface. The shrinking temperature is typically in a range of 50 to 100 degrees C. In particular the shrink tube 2 can be made from plural annular sections which are applied to the support tube 1 adjacent to each other.

Figure 2:
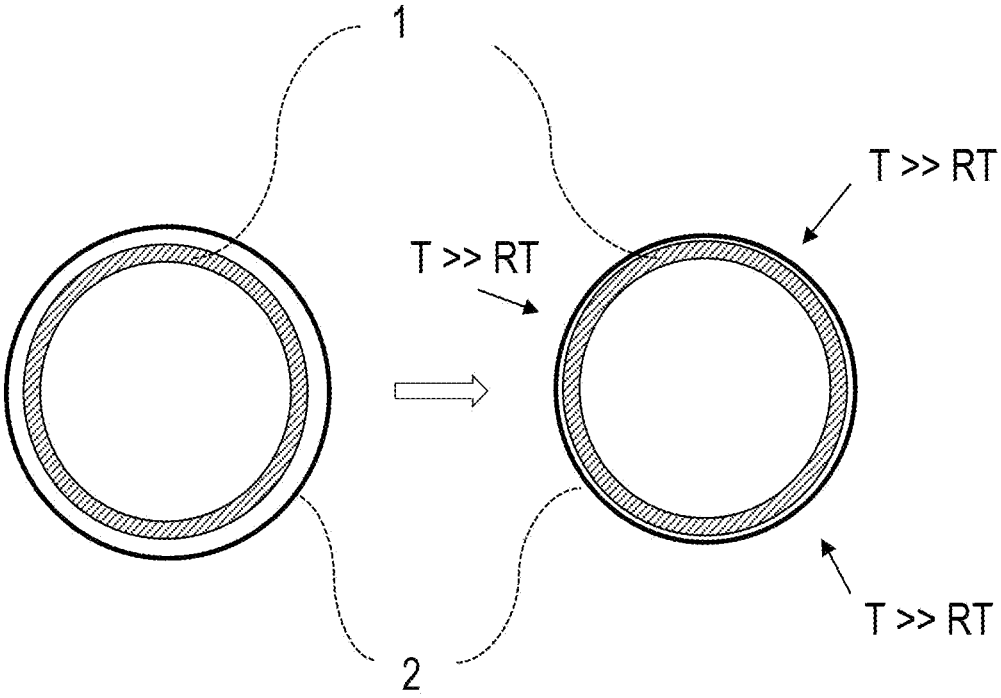
FIG. 2 illustrates a schematic view showing an application of the shrink tube.

FIG. 2 illustrates how the shrink tube 2 is applied to the support tube 1 to practice the invention. Initially the expanded shrink tube is pulled over the support tube 1 at room temperature RT. Thereafter, the shrink tube 2 is heated, for example, by a hot air blower so that the shrink tube contracts and is fixed at the support tube 1. Thus, the shrink tube forms a surface that comes in contact with the screen during drawing and over which the screen is drawn.

Figure 3:
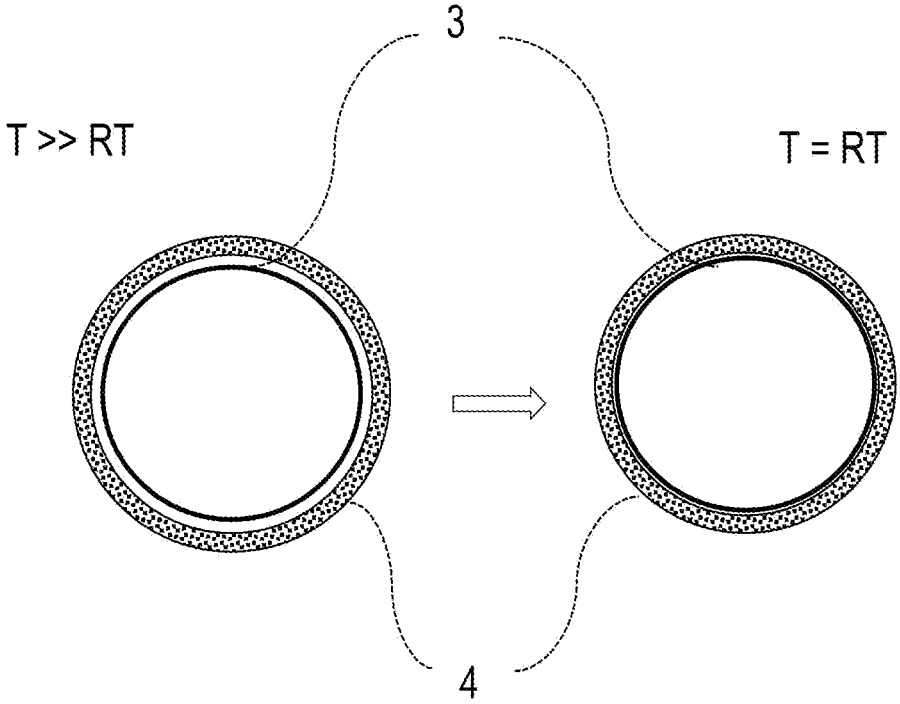
FIG. 3 illustrates a schematic view showing shrink fit application of the sliding bushings.

FIG. 3 schematically illustrates how the sliding bushings 4 can be attached at the telescoping rod 3. Initially the sliding bushings 4 are heated above room temperature RT so that they expand slightly and can be slid onto the telescoping rod 3 into the desired position. The sliding bushings 4 contract during cooling so that they are fixed on the telescoping rod 3 by a press fit. This facilitates a safe and reliable support for displacing the telescoping rod 3 in the support tube 1 which requires little installation space and adds little additional weight.

Figure 4:
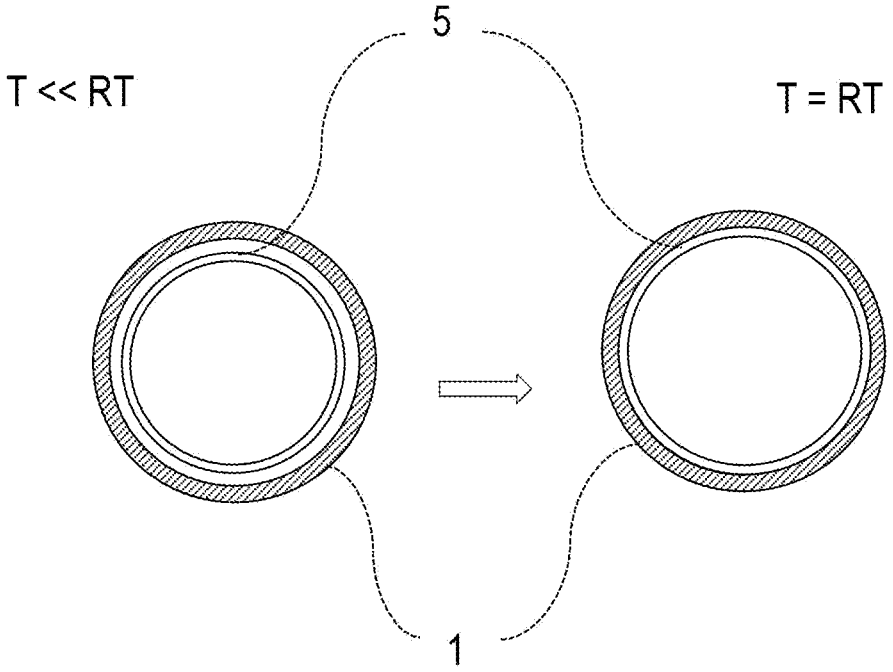
FIG. 4 illustrates a schematic view showing shrink fit application of the head pieces.

FIG. 4 shows the assembly of the head piece 5 in the support tube 1. The metal head pieces are cooled low enough so that they can be inserted into the support tube 1. When the head pieces heat up to room temperature RT again, they expand and are fixed in the support tube 1 by a press fit. The head pieces 5 reinforce and protect the edges of the support tube 1 against being damaged. Additionally, the head pieces can support the telescoping rod 3 during linear displacement or facilitate attaching or receiving the support tube 1 at a frame, at a building or at a building crane.

REFERENCE NUMERALS AND DESIGNATIONS

1 support tube
2 shrink tube
3 telescoping rod
4 sliding bushing
5 head piece
10 screen support rod
11 screen
RT room temperature

What is claimed is:

1. A screen support rod for screen drawing into a paper machine, the screen support rod comprising:
- a support tube made from carbon fiber composite material;
- a telescoping rod; and
- a bearing that supports the telescoping rod axially movable in an interior of the support tube,
- wherein the support tube includes a shrink tube that forms a surface that supports the screen during the screen drawing.

2. The screen support rod according to claim 1, wherein the shrink tube is applied in plural shrink tube sections adjacent to each other.

3. The screen support rod according to claim 1, wherein the support tube is configured as a wound carbon fiber reinforced synthetic material tube.

4. The screen support rod according to claim 1, wherein the telescoping rod is provided as a metal tube made from aluminum or an aluminum alloy.

5. The screen support rod according to claim 1, wherein the telescoping rod is a carbon fiber reinforced synthetic material tube or a wound carbon fiber reinforced synthetic material tube.

6. The screen support rod according to claim 1, wherein the bearing for the telescoping rod includes at least one sliding bushing made from a synthetic material.

7. The screen support rod according to claim 6, wherein the at least one sliding bushing is attached at the telescoping rod by a press fit.

8. The screen support rod according to claim 6,
- wherein the support tube includes metal head pieces at each end, and
- wherein the metal head pieces are fixed in the support tube by a press fit.

9. The screen support rod according to claim 8, wherein one of the head pieces supports the telescoping rod during displacement in the support tube.

10. The support tube for the screen support rod according to claim 1, wherein the support tube is configured as a carbon fiber reinforced synthetic material tube, and
- wherein the shrink tube is applied to the support tube so that the shrink tube forms a surface that supports the screen during the screen drawing.

11. The support tube according to claim 10, wherein the shrink tube is provided in plural shrink tube sections adjacent to each other.

12. The support tube according to claim 10, wherein the support tube is a wound carbon fiber reinforced synthetic material tube.

13. The support tube according to claim 10, further comprising:
- a respective metal head piece at each end of the support tube,
- wherein the respective metal head piece (5) is attached in the support tube by a press fit.

14. The screen support rod according to claim 6, wherein the at least one sliding bushing is made from polyoxymethylene.

15. The screen support rod according to claim 6, wherein the at least one sliding bushing includes two sliding bushings.

* * * * *